US006609488B2

(12) United States Patent
Nagae et al.

(10) Patent No.: US 6,609,488 B2
(45) Date of Patent: Aug. 26, 2003

(54) APPARATUS AND PROCEDURE FOR STARTING VEHICLE ENGINE

(75) Inventors: Toshihiro Nagae, Aichi (JP); Masaki Hayashi, Aichi (JP); Hirokazu Shamoto, Aichi (JP); Shinji Kishida, Toyota (JP)

(73) Assignees: Kabushiki Kaisha Tokai Rika Denki Seisakusho, Aichi (JP); Toyota Jidosha Kabushiki Kaisha, Aich-ken (JP)

( * ) Notice: Subject to any disclaimer, the term of this patent is extended or adjusted under 35 U.S.C. 154(b) by 0 days.

(21) Appl. No.: 09/977,068

(22) Filed: Oct. 12, 2001

(65) Prior Publication Data

US 2002/0112689 A1 Aug. 22, 2002

(30) Foreign Application Priority Data

Oct. 13, 2000 (JP) ..... 2000-313529

(51) Int. Cl.[7] ..... F02N 11/08

(52) U.S. Cl. ..... 123/179.3; 123/179.4; 701/113; 307/10.6

(58) Field of Search ..... 123/179.3, 179.4; 701/113; 307/10.6

(56) References Cited

U.S. PATENT DOCUMENTS 4,236,594 A * 12/1980 Ramsperger ..... 180/167
4,490,620 A * 12/1984 Hansen ..... 123/179.3
4,862,364 A * 8/1989 Matsuda ..... 364/424.01
4,901,690 A * 2/1990 Cummins et al. ..... 123/179.3
5,798,577 A * 8/1998 Lesesky et al. ..... 307/10.9
5,831,804 A * 11/1998 Vilou ..... 123/179.3
5,970,938 A * 10/1999 Hisamoto et al. ..... 123/179.3
6,456,034 B1 * 9/2002 Vilou ..... 123/179.3

FOREIGN PATENT DOCUMENTS

JP 56-169474 U * 12/1981

* cited by examiner

*Primary Examiner*—Thomas N. Moulis
(74) *Attorney, Agent, or Firm*—Sheridan Ross PC

(57) ABSTRACT

A vehicle engine starting apparatus that allows a driver to start an engine easily. The apparatus has a plurality of operation modes. The apparatus includes a starter motor, an ignition switch, and a control circuit. The ignition switch is pressed to generate an operation signal. The control circuit is connected to the starter motor and the ignition switch. The control circuit changes the current operation mode or activates the starter motor to start the engine depending on the nature of the operation signal. The control circuit judges whether to switch the operation modes of the electric system or to activate the starter motor depending on the duration of the operation signal,

17 Claims, 3 Drawing Sheets

ON/OFF Starters of Relays in Each Mode

| Relay/Modes | OFF Mode | ACC Mode | ON Mode | When Starting the Engine |
|---|---|---|---|---|
| ACC Relay 11 | OFF | ON | ON | ON |
| IG Relay 12 | OFF | OFF | ON | ON |
| Starter Relay 13 | OFF | OFF | OFF | Automatically Turned OFF When Engine Starting Is Completed |

APPARATUS AND PROCEDURE FOR STARTING VEHICLE ENGINE

BACKGROUND OF THE INVENTION

The present invention relates to apparatuses and procedures for starting a vehicle engine.

A conventional vehicle engine starting apparatus starts an engine when a key is rotated in a key cylinder and an ignition switch is pressed. Thus, when starting the engine with the engine starting apparatus, the key is first inserted in the key cylinder.

The key is then rotated in the key cylinder from OFF position to LOCK or ACC (accessory) or ON (ignition) position, thus switching an electric system to a corresponding mode. More specifically, the OFF position corresponds to an OFF mode, the ACC position corresponds to an ACC mode, and the ON position corresponds to an ON mode.

Afterwards, the ignition switch, which is separate from the key cylinder, is pressed to activate a starter motor such that the engine starts.

In other words, the vehicle engine starting apparatus includes two independent operations, the rotating of the key in the key cylinder and the pressing of the ignition switch, to start the engine. This complicates the starting of the engine.

BRIEF SUMMARY OF THE INVENTION

Accordingly, it is an objective of the present invention to provide an apparatus and a procedure for easily starting a vehicle engine.

To achieve the foregoing and other objectives and in accordance with the purpose of the present invention, the invention provides a vehicle engine starting apparatus that has a plurality of operation modes. The apparatus includes a starter motor, an ignition switch, and a control circuit. The starter motor starts an engine. The ignition switch is pressed to generate an operation signal. The control circuit is connected to the starter motor and the ignition switch. The control circuit changes the current operation mode or activates the starter motor to start the engine depending on the nature of the operation signal.

A further perspective of the present invention is a vehicle engine starting apparatus that has a plurality of operation modes. The apparatus includes a starter motor, an ignition switch, a plurality of switches, and a control circuit. The starter motor starts the engine. The ignition switch is pressed to generate an operation signal. The switches change the current operation mode. The control circuit is connected to the starter motor and the switches. The control circuit controls the switches to change the current operation mode or activates the starter motor to start the engine depending on the nature of the operation signal.

A further perspective of the present invention is a method of starting an engine that has a plurality of operation modes. The method includes pressing an ignition switch, changing the current operation mode by activating the ignition switch in a first manner, and activating the starter motor to start the engine by activating the ignition switch in a second manner. The first manner includes activating the ignition switch for a period of time that is equal to or greater than a predetermined reference time. The second manner includes activating the ignition switch for a period of time that is less than the reference time.

A further perspective of the present invention is a method of starting an engine that has a plurality of operation modes.

The method includes pressing an ignition switch, changing the current operation mode by activating the ignition switch in a first manner, and activating the starter motor to start the engine by activating the ignition switch in a second manner. The first manner includes activating the ignition switch for a period of time that is less than a predetermined reference time. The second manner includes activating the ignition switch for a period of time that is equal to or greater than the reference time.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
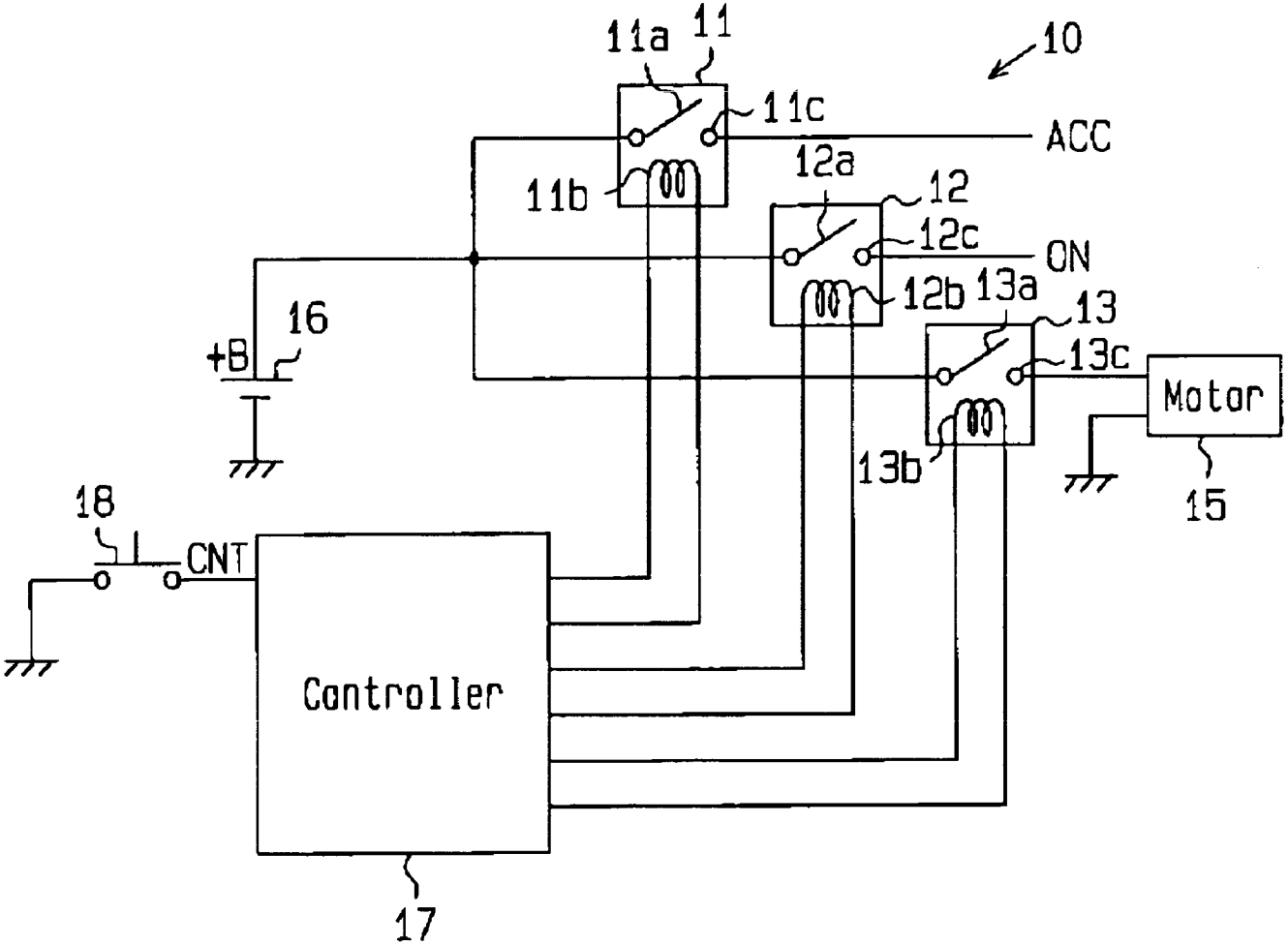
FIG. 1 is a block diagram schematically showing an electric circuit or a vehicle engine starting apparatus of a first embodiment according to the present invention.

In the drawings, like numerals are used for like elements throughout.

As shown in FIG. 1, an engine starting apparatus 10 of a first embodiment according to the present invention includes an accessory (ACC) relay 11, an ignition (IG) relay 12, and a starter relay 13.

The ACC relay 11 has a fixed contact 11*c* that is connected to an electric circuit (not shown) of an ACC system. The IG relay 12 has a fixed contact 12*c* that is connected to an electric circuit (not shown) of an IG system. The starter relay 13 has a fixed contact 13*c* that is connected to a starter motor 15 that starts an engine. The relays 11–13 respectively include moving contacts 11*a*, 12*a*, 13*a* that are connected to a battery 16.

The relays 11–13 include drive coils 11*b*, 12*b*, 13*b*, respectively. The drive coils 11*b*–13*b* drive the associated moving contacts 11*a*–13*a*. Each drive coil 11*b*–13*b* is connected to a controller 17. The controller 17 activates and deactivates the drive coils 11*b*–13*b*.

An ignition switch 18 is located near a steering wheel and is connected to the controller 17. The first embodiment has the single ignition switch 18. When the ignition switch 18 is pressed, an operation signal CNT to a controller 17 is generated. The controller 17 switches an electric system among an OFF mode, an ACC mode, and an ON mode or activates the starter motor 15 depending on the nature of the operation signal CNT. More specifically, the controller 17 judges whether to switch the modes of the electric system or to activate the starter motor depending on the length of time that the ignition switch 18 is closed (the time during which the operation signal CNT continues).

In other words, when receiving the operation signal CNT for a predetermined reference time (in the first embodiment, for example, two seconds) or longer, the controller 17 switches the electric system selectively among the OFF, ACC, and ON modes.

Figures 2A, 2B:
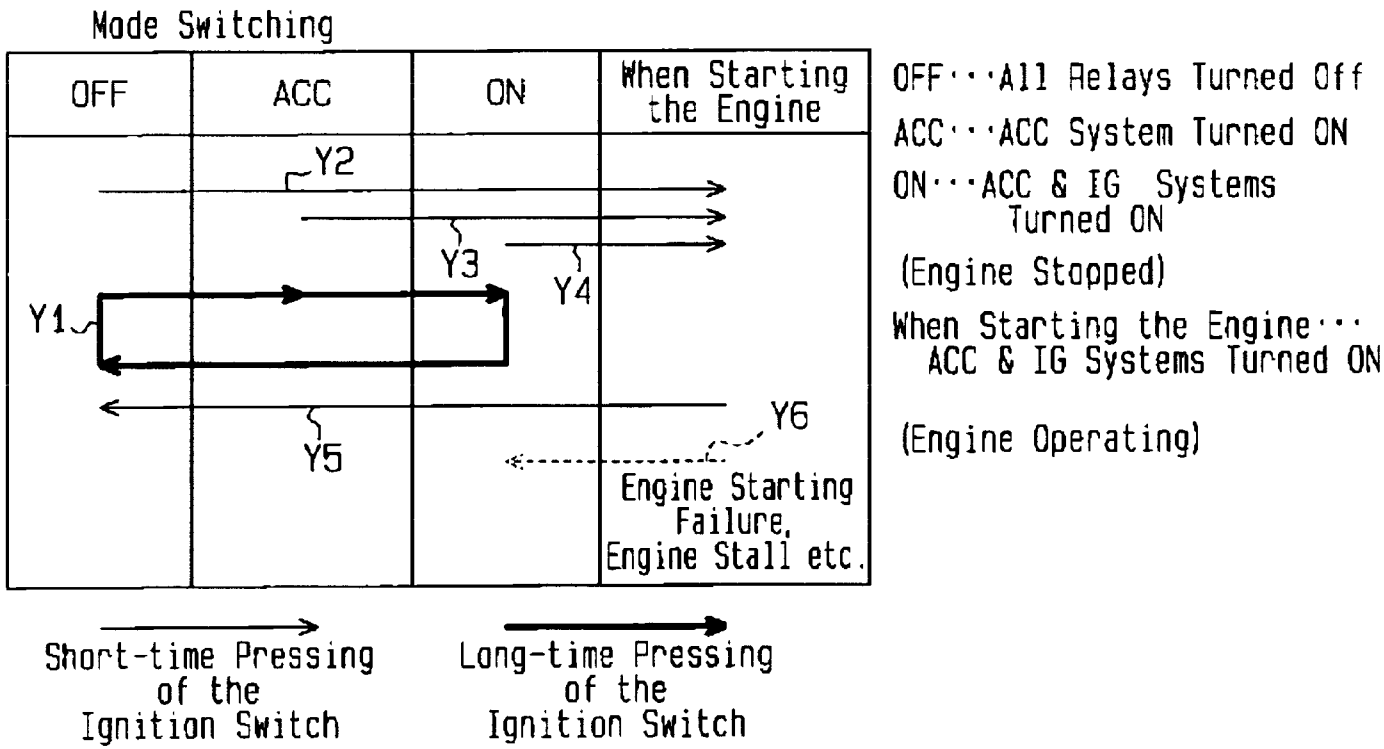
FIG. 2A is a table illustrating the state of each relay in each operation mode of the apparatus of FIG. 1.
FIG. 2B is a diagram illustrating the operation of the apparatus of FIG. 1 in accordance with different modes.

As indicated by the arrows Y1 of FIG. 2B, when the ignition switch 18 is closed such that the operation signal CNT continues, the controller 17 switches the electric system among the different modes at constant time intervals. In the first embodiment, the controller 17 switches the electric system among the OFF, ACC, and ON modes in this order every two seconds, as long as the ignition switch 18 is closed (depressed). An indicator (not shown) on an instrument panel indicates the current mode of the electric system.

In contrast, if the operation signal CNT lasts less than the reference time (less than two seconds), the controller 17 activates the starter motor 15. The controller 17 has a memory that stores data concerning the reference time.

As indicated by the arrows Y2, Y3, and Y4 of FIG. 2B, the controller 17 controls the starter relay 13 to activate the starter motor 15 if the control signal lasts less than the reference time, regardless of the current mode of the electric system.

Afterwards, if the controller 17 determines that the starting of the engine has been completed normally or has failed (an engine stall has occurred), the controller 17 holds the electric system in the ON mode, as indicated by the arrow Y6 of FIG. 2B.

If the engine stalls, the procedure to start the engine is repeated. Further, if the engine is operating and the controller 17 receives the operation signal CNT that lasts less than the reference time, the controller 17 switches the electric system from the ON mode to the OFF mode, as indicated by the arrow Y5 of FIG. 2B.

FIG. 2A shows the state of each relay 11–13 in each mode of the electric system. More specifically, as shown in the chart, the controller 17 turns off the relays 11 to 13 in the OFF mode.

In the ACC mode, the controller turns on only the ACC relay 11 and turns off the remaining relays 12, 13.

In the ON mode, the controller 17 turns on the ACC relay 11 and the IG relay 12 and turns off the starter relay 13. To start the engine, the controller 17 turns on all relays 11–13.

A procedure for starting the engine with the engine starting apparatus 10 will hereafter be described. In the following, pressing the ignition switch 18 for the reference time or longer (two second or longer) is referred to as "long time pressing". In contrast, pressing the ignition switch 18 for less than the reference time (less than two second) is referred to as a "short time pressing". The long time pressing generates an operation signal LCNT, or extended time signal, that lasts for the reference time or longer. In the same manner, the short time pressing generates an operation signal SCNT, or short time signal, that lasts for less than the reference time.

Starting and Stopping of the Engine

If the short time pressing of the ignition switch 18 is performed to generate the short time signal SCNT in the OFF or ACC or ON mode, the controller 17 turns on the relays 11 to 13 to activate the starter motor 15 in response to the signal SCNT, thus starting the engine.

If the engine fails to start, or if the engine stalls, the controller 17 holds the electric system in the ON mode. Thus, if the short time pressing of the ignition switch 18 is repeated, the controller 17 activates the starter motor 15, thus starting the engine.

When the engine is operating and the short time pressing of the ignition switch 18 is performed, the controller 17 switches the electric system to the OFF mode. In this mode, the controller 17 turns off the relays 11 to 13, thus stopping the engine.

Switching of the Modes of the Electric System

When the long time pressing of the ignition switch 18 is performed to generate the long time signal LCNT in the OFF mode, the controller 17 switches the electric system among the OFF mode, the ACC mode, and the ON mode in this order in response to the signal LCNT. For example, to switch from the OFF mode to the ON mode, the ignition switch 18 is pressed until the controller 17 switches the electric system from the OFF mode to the ACC mode and then to the ON mode. The ignition switch 18 is released once the electric system is switched to the ON mode.

In the first embodiment, the controller 17 switches from one mode to another every two seconds. Accordingly, to switch from the OFF mode to the ACC mode or from the ACC mode to the ON mode, the ignition switch 18 must be pressed for two seconds or longer, but less than four seconds.

Further, to switch from the OFF mode to the ON mode, the ignition switch 18 must be pressed for four seconds or longer, but less than six seconds. In addition, to return from the OFF mode to the OFF mode through the ACC mode and the ON mode, the ignition switch 18 must be pressed for six second or longer, but less than eight seconds.

The vehicle starting apparatus 10 of the first embodiment has the following advantages.

(1) The controller 17 switches the modes of the electric system and starts the engine in accordance with the operation signal CNT generated through pressing of the ignition switch 18. This makes it easy for a driver to start the engine.

(2) The controller 17 judges whether to switch the modes of the electric system or to activate the starter motor 15 depending on the time during which the ignition switch 18 is closed (pressed). That is, the ignition switch 18 does not need any additional component for the judgment. This reduces the manufacturing cost of the engine starting apparatus 10. Further, the ignition switch 18 does not necessarily have to be located in the instrument panel, and the instrument panel is simple to design. In addition, the front portion of the passenger compartment has an improved appearance.

(3) If the ignition switch 18 is closed for a period that is less than the reference time, the controller 17 activates the starter motor 15. This reduces the time needed for starting the engine. This is advantageous particularly for delivery vehicles in which the engine is started and stopped frequently.

(4) If the ignition switch 18 is pressed for the reference time or longer, the controller 17 switches the modes of the electric system. In other words, if the pressing of the ignition switch 18 continues for only a relatively short time, the controller 17 does not switch the modes. This prevents undesired switching of the modes.

(5) The controller 17 switches the electric system among the OFF mode, the ACC mode, and the ON mode in this order at predetermined time intervals (every two seconds) during extended closure of the ignition switch 18. This allows a driver to switch the electric system to a desired mode by pressing the ignition switch 18 without releasing the ignition switch 18 until the desired mode is reached.

(6) If the engine fails to start, the controller 17 holds the electric system in the ON mode. The controller 17 thus only has to turn on the starter relay 13, instead of turning on all the relays 11-13, to start the engine. This conserves the battery 16, as compared to the case in which the controller 17 turns on the relays 11-13.

A vehicle engine starting apparatus 20 of a second embodiment according to the present invention will hereafter be described. The electric configuration of the second embodiment is identical to that of the first embodiment of FIG. 1. Thus, only the differences between the first embodiment and the second embodiment will be described in the following.

In the second embodiment, the controller 17 switches the modes of the electric system in response to an operation signal that lasts less than a predetermined reference time (less than two seconds), or a short time signal SCNT. More specifically, as indicated by the arrows Y11 of FIG. 3, the controller 17 switches from one mode to another at certain time intervals.

In contrast, the controller 17 activates the starter motor 15 in response to an operation signal that lasts for the reference time or longer (a long time signal LCNT). As indicated by the arrows Y12, Y13, and Y14 of FIG. 3, the controller 17 activates the starter motor 15 every time the controller 17 receives the long time signal LCNT, regardless of the current mode of the electric system.

Figure 3:
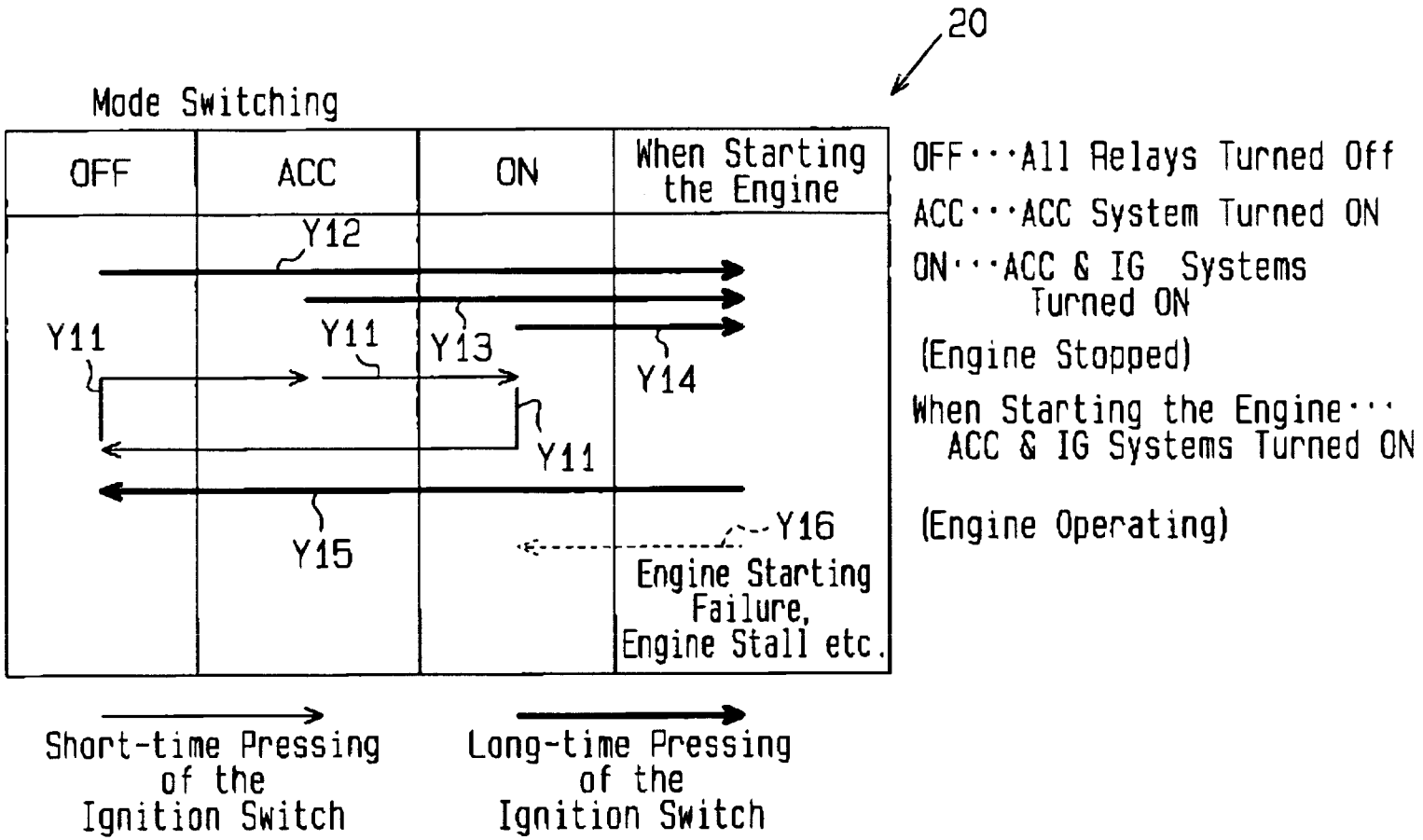
FIG. 3 is a diagram illustrating the operation of a vehicle engine starting apparatus of a second embodiment according to the present invention in accordance with different modes.

Further, if starting of the engine is completed normally or fails (stalls), the controller 17 holds the electric system in the ON mode, as indicated by the arrow Y16 of FIG. 3. In addition, if the engine is operating and the controller 17 receives the long time signal LCNT, the controller 17 switches the electric system from the ON mode to the OFF mode, as indicated by the arrow Y15 of FIG. 3.

The state of each relay 11–13 in each mode of the second embodiment is the same as that of the first embodiment. That is, the controller 17 turns the relays 11–13 on or off, as shown in FIG. 2A.

A procedure for starting the engine with the engine starting apparatus 20 is as follows.

Starting and Stopping of the Engine

If the long time pressing of the ignition switch 18 is performed to generate the long time signal LCNT in the OFF or ACC or ON mode, the controller 17 turns on the relays 11-13 to activate the starter motor 15 in response to the signal LCNT (as indicated by the arrows Y12–Y14 of FIG. 3), thus starting the engine. If the engine fails to start, the controller 17 switches the electric system to the ON mode. Thus, when the long time pressing of the ignition switch 19 is repeated, the controller 17 activates the starter motor 15 to start the engine (as indicated by the arrow Y14 of FIG. 3).

When the engine is operating and the long time pressing of the ignition switch 18 is performed to generate the long time signal LCNT, the controller 17 switches the electric system from the ON mode to the OFF mode (as indicated by the arrow Y15 of FIG. 3). In the OFF mode, the controller 17 turns off the relays 11–13 and stops the engine.

Switching of the Modes of the Electric System

If, for example, the electric system is in the OFF mode, the controller 17 switches the electric system from the OFF mode to the ACC mode and then to the ON mode every time the short time pressing of the ignition switch 18 is performed.

The vehicle engine starting apparatus 20 of the second embodiment has the following advantages.

(1) If the duration of the signal CONT of the ignition switch 18 lasts for the reference time or longer, the controller 17 activates the starter motor 15. In other words, if the ignition switch 15 is pressed for a relatively short time, the controller 17 maintains the starter motor 15 in a de-activated state. Accordingly, if, for example, an object hits the ignition switch 18 and closes the ignition switch 18 for a relatively short time, the controller 17 maintains the starter motor 15 in a de-activated state. This prevents the engine from being accidentally started.

(2) If the duration of the signal CNT of the ignition switch 18 is less than the reference time, the controller 17 switches the operation modes of the electric system. It is thus possible to switch from one mode to another only through a single pressing of the ignition switch 18. This makes it easy to manipulate the ignition switch 18.

It should be apparent to those skilled in the art that the present invention may be embodied in many other specific forms without departing from the spirit or scope of the invention. Particularly, it should be understood that the invention may be embodied in the following forms.

Each embodiment may include a plurality of ignition switches. For example, a switch for the operation modes of the electric system may be provided separately from a switch for starting the engine.

The controller 17 may switch the electric system from one mode to another or activate the starter motor 15 depending on the number of times that the ignition switch 18 is pressed in a predetermined period. For example, the controller 17 may switch the modes of the electric system if the ignition switch 18 is pressed a predetermined number of times (for example, twice) in a predetermined period. In this case, the controller 17 activates the starter motor 15 if the ignition switch 18 is pressed once in the predetermined period.

In the illustrated embodiments, the reference time may be changed to, for example, one to three seconds However, it is preferred that the reference time is selected from a range of 1.5 to 2.5 seconds.

The present invention may be applied to motorcycles.

The present examples and embodiments are to be considered as illustrative and not restrictive and the invention is not to be limited to the details given herein, but may be modified within the scope and equivalence of the appended claims.

What is claimed is:

1. An engine starting apparatus of a vehicle wherein the vehicle has a plurality of electrical systems modes, the apparatus comprising:

a starter motor for starting an engine;

an ignition switch, wherein the ignition switch is pressed to generate an operation signal; and a control circuit, which is connected to the starter motor and the ignition switch, wherein the control circuit changes the current electrical system mode or activates the starter motor to start the engine depending on the nature of the operation signal.

2. The vehicle engine starting apparatus according to claim 1, wherein the control circuit judges whether to change the current electrical system mode or to activate the starter motor depending on the duration of the operation signal.

3. The vehicle engine starting apparatus according to claim 2, wherein the control circuit activates the starter motor if the duration of the operation signal is less than a predetermined reference time.

4. The vehicle engine starting apparatus according to claim 3, wherein the control circuit changes the current electrical system mode if the duration of the operation signal is equal to or greater than the reference time.

5. The vehicle engine starting apparatus according to claim 4, wherein the electrical system modes of the apparatus include an OFF mode, an accessory mode and an ON mode, and the control circuit changes the current mode among the OFF mode, the accessory mode, and the ON mode in this order at certain time intervals.

6. The vehicle engine starting apparatus according to claim 5, wherein the control circuit maintains the apparatus in the ON mode if the engine fails to start

7. The vehicle engine starring apparatus according to claim 2, wherein the control circuit activates the starter motor if the duration of the operation signal is equal to or greater than a predetermined reference time.

8. The vehicle engine starting apparatus according to claim 7, wherein the control circuit changes the current electrical system mode if the duration of the operation signal is less than the reference time.

9. The vehicle engine starting apparatus according to claim 8, wherein the electrical system modes of the apparatus include an OFF mode, an accessory mode and an ON mode, and the control circuit changes the current mode among the OFF mode, the accessory mode, and the ON mode in this order at certain time intervals.

10. The vehicle engine starting apparatus according to claim 9, wherein the control circuit maintains the apparatus in the ON mode if the engine fails to start

11. The vehicle engine starting apparatus according to claim 1, wherein the control circuit judges whether to change the current electrical system mode or to activate the starter motor depending on the number of times that the ignition switch generates the operation signal.

12. The vehicle engine starting apparatus according to claim 1, wherein the control circuit maintains the apparatus in a predetermined mode if the engine fails to start.

13. An engine starting apparatus of a vehicle wherein the vehicle has a plurality of electrical system modes, the apparatus comprising:

a starter motor for starting an engine;

an ignition switch, wherein the ignition switch is pressed to generate an operation signal;

a plurality of switches, wherein the switches change the current electrical system mode; and a control circuit, which is connected to the starter motor and the switches, wherein the control circuit controls the switches to change the current electrical system mode or activates the starter motor to start the engine depending on the nature of the operation signal.

14. A method of starting an engine of a vehicle wherein the vehicle has a plurality of electrical system modes, the method comprising:

pressing an ignition switch;

changing the current electrical system mode by activating the ignition switch in a first manner; and activating the starter motor to start the engine by activating the ignition switch in a second manner, wherein the first manner includes activating the ignition switch for a period of time that is equal to or greater than a predetermined reference time, and the second manner includes activating the ignition switch for a period of time that is less tan to reference time.

15. The method according to claim 14, wherein activating the ignition switch is closing the ignition switch.

16. A method of starting an engine of a vehicle wherein the vehicle has a plurality of electrical system modes, the method comprising:

pressing an ignition switch;

changing the current electrical system mode by activating the ignition switch in a first manner; and activating the starter motor to start the engine by activating the ignition switch in a second manner, wherein the first manner includes activating the ignition switch for a period of time that is less than a predetermined reference time, and the second manner includes activating the ignition switch for a period of tune that is equal to or greater than the reference time.

17. The method according to claim 16, wherein activating the ignition switch is closing the ignition switch.

* * * * *